US006951275B2

(12) United States Patent
Serra Galdos

(10) Patent No.: US 6,951,275 B2
(45) Date of Patent: Oct. 4, 2005

(54) COMPLEX PACKAGING DEVICE

(76) Inventor: Rosa Elena Serra Galdos, Mosén Joaquim Roca 10, 08960-Santa Coloma de Cervell´´ (ES)

( * ) Notice: Subject to any disclaimer, the term of this patent is extended or adjusted under 35 U.S.C. 154(b) by 0 days.

(21) Appl. No.: 10/499,009

(22) PCT Filed: Dec. 5, 2002

(86) PCT No.: PCT/ES02/00579

§ 371 (c)(1),
(2), (4) Date: Jun. 18, 2004

(87) PCT Pub. No.: WO03/053812

PCT Pub. Date: Jul. 3, 2003

(65) Prior Publication Data

US 2005/0016874 A1 Jan. 27, 2005

(30) Foreign Application Priority Data

Dec. 20, 2001 (ES) ..... 200102842

(51) Int. Cl.[7] ..... B65D 81/32

(52) U.S. Cl. ..... 206/221; 206/457; 206/568; 215/6; 215/DIG. 8; 426/112; 426/120

(58) Field of Search ..... 206/219–222, 206/457, 568; 215/6, 227, DIG. 8; 426/106, 112, 115, 120, 124

(56) References Cited

U.S. PATENT DOCUMENTS 611,520 A * 9/1898 Smith ..... 206/221
2,900,100 A * 8/1959 Debat et al. ..... 206/219
3,198,194 A * 8/1965 Wilburn ..... 206/221
3,275,448 A * 9/1966 Sommer ..... 426/115
4,331,233 A * 5/1982 Braymer, Jr. ..... 206/221
4,820,533 A * 4/1989 Seaborne et al. ..... 426/76
4,874,618 A * 10/1989 Seaborne et al. ..... 426/76
5,008,507 A * 4/1991 Pesheck et al. ..... 426/107
5,101,084 A * 3/1992 Atwell et al. ..... 219/728
5,456,929 A * 10/1995 Mifune et al. ..... 426/118
5,676,244 A * 10/1997 Green et al. ..... 206/221

FOREIGN PATENT DOCUMENTS

| | | | |
|---|---|---|---|
| DE | 29608972 U1 | * | 9/1996 |
| EP | 0295104 A1 | * | 12/1988 |
| FR | 2536251 | * | 5/1984 |
| GB | 2298180 A | * | 8/1996 |
| WO | 9815463 | * | 4/1998 |
| WO | 0010884 | * | 3/2000 |

* cited by examiner

*Primary Examiner*—Jim Foster
(74) *Attorney, Agent, or Firm*—Staas & Halsey LLP

(57) ABSTRACT

Packaging device allowing two or more products that are mixed at the time of use thereof to be expended in a single package, including a package differentiated in two or more enclosures, one of them provided with an openable stopper, separated by a movable stoppering partition and each filled with one of the products to be contained separately in the package and with a gaseous fluid compatible with each of said products, the gaseous fluid being substantially subject to pressures different from normal atmospheric pressure, which pressures exert an equal force on opposite faces of the internal movable stoppering partition, maintaining a balance between both enclosures.

10 Claims, 2 Drawing Sheets

COMPLEX PACKAGING DEVICE

FIELD OF THE INVENTION

The present invention relates to a complex packaging device, especially one allowing two or more products that may only be mixed at the time of use thereof to be expended in a single package, by avoiding the packaging of such products individually to bring them together in one shipping unit where they must be separately unstoppered at the time of use and mixed in one of the packages or in a third container.

STATE OF THE ART

Pharmaceutical compounds formed by the association of two or more components are known, which alone, under appropriate conditions, will keep for a long time, but which in contact with other components have a short effective life or "pot life", it being necessary to administer the medicinal drug immediately or within a short space of time.

Likewise, the same situation occurs in the use of many industrial products, such as the two-component adhesives, certain putties, etc.

On the other hand, now in the food field, there are known drinks that should be consumed at the time of their preparation, such as those constituted by red wine or sparkling wine ("cava") in which a fresh fruit cocktail is incorporated, which are respectively well-known as "sangria" and "tisana", wherein if a short time is allowed to elapse after the preparation thereof the fruit softens and becomes unpleasant to eat.

Another case, also in the food field, is that of pasta-containing soups, since once cooked the pasta cannot remain in the broth for a long time, since it gradually absorbs liquid in excess, whereby it swells and becomes too soft, losing its proper texture.

In all the above-mentioned cases and in others that will be cited, the problem arises that such products cannot be marketed already packaged because the mixture of the components denatures the product in a short time.

Consequently, it would be desirable to have a packaging device that allowed the two or more products, which should be mixed for consumption, to be contained in a single package and that the mixing operation were automatic, unlike certain products whose components are expended in separate packages inside one same unit, which should be opened up individually by the user and mixed in any container or in one of the packages themselves, such as is the case of certain antibiotics, of the so-called long alcoholic drinks, such as rum and coke, gin-fizz, etc.

SUMMARY OF THE INVENTION

With the purpose of obtaining a complex packaging device in accordance with the expressed desires, the solution has been adopted of containing the products to be mixed in one same package and that they are hermetically separated by means that are kept in such closed position by balance of the fluid pressure and are mixed when opening the package by an imbalance of the fluid pressure.

In accordance with the foregoing solution, the complex packaging device of the present invention has been developed, according to which there is provided a package that is differentiated in two enclosures, one of them being provided with an openable external stopper, which are separated by a moveable stoppering partition and each of said enclosures is filled with one of the products to be contained separately in the package and with a gaseous fluid compatible with each of said products, said gaseous fluid contained in both enclosures being substantially subject to pressures different from the atmospheric pressure, either above or below the limits of the normal oscillations thereof, which pressures exert an equal force on both sides of the internal moveable stoppering partition, maintaining it in functional balance between both enclosures.

An essential characteristic of the invention consists of the package being differentiated in at least two enclosures communicated with each other by a cylindrical or polygonal intermediate tubular portion, preferably of smaller section than the enclosures.

Another characteristic of the invention resides in that the internal moveable stoppering partition is located in the intermediate tubular portion in which it may slide slightly, without losing its stoppering capacity, because of the forces formed in both enclosures by small pressure differences in the gaseous fluids contained therein. Evidently, the need to provide for the moveability of said internal stoppering partition presupposes that the tubular portion is longer than the thickness of the internal stoppering partition itself.

The invention contemplates the fact that the stoppering partition is constituted by a synthetic material, or by an edible or otherwise natural material, such as cork, pineapple, green papaya, green apple and the like.

In some cases, it has been contemplated that the stoppering partition is diametrically divided into two or more parts that also act as stopper by their juxtaposed flat surfaces.

It has also been contemplated that the stoppering partition is able to be held in place lightly at least by a small shoulder provided in the intermediate tubular portion of the package that does not prevent unstoppering or the contents being mixed in the enclosures at the time of opening the package.

One application of the complex packaging device of the invention is when one of the enclosures of the package contains a pharmaceutical, cosmetic or other active principle, while in the other enclosure there is contained a vehicle, a solvent or a companion product of the active principle.

Another application of the complex packaging device of the invention is when one of the enclosures of the package contains a mixture of fruits in an aromatic liquid, while in the other enclosure there is contained a wine, in which case the stoppering partition is constituted by a fruit portion, without excluding the possibility of it being made of another material.

The invention contemplates the fact that when a still wine is used, a reduced pressure is formed in the enclosures, while, when a sparkling wine is used, a high pressure is formed in the enclosures.

Another application of the complex packaging device consists of a cooked edible pasta, such as for example Italian pasta, being contained in one of the enclosures of the package, while in the other there is contained the corresponding broth for a soup, with the same level of reduced pressure being maintained in both enclosures.

Another application of the complex packaging device is that one of the enclosures of the package contains a cereal product, while in the other there is contained a dairy product, with the same level of reduced pressure being maintained in both enclosures.

Finally, another application of the packaging device of the invention consists of several secondary enclosures being arranged in a package, and connected over a tubular portion or short neck provided with a stoppering partition with a main enclosure, all of them having of a closure, with only that of the main enclosure being openable, each secondary enclosure containing under a reduced pressure a liquor, syrup, fruits or other items that are mixed with the content of the main enclosure at the time of the opening thereof, there being obtained a cocktail-like consumable product.

BRIEF DESCRIPTION OF THE DRAWINGS

To facilitate the understanding of the foregoing ideas, there is described hereinbelow the object of the invention, with reference to the accompanying illustrative drawings in which.

DETAILED DESCRIPTION OF SOME EMBODIMENTS OF THE INVENTION

Figure 1:
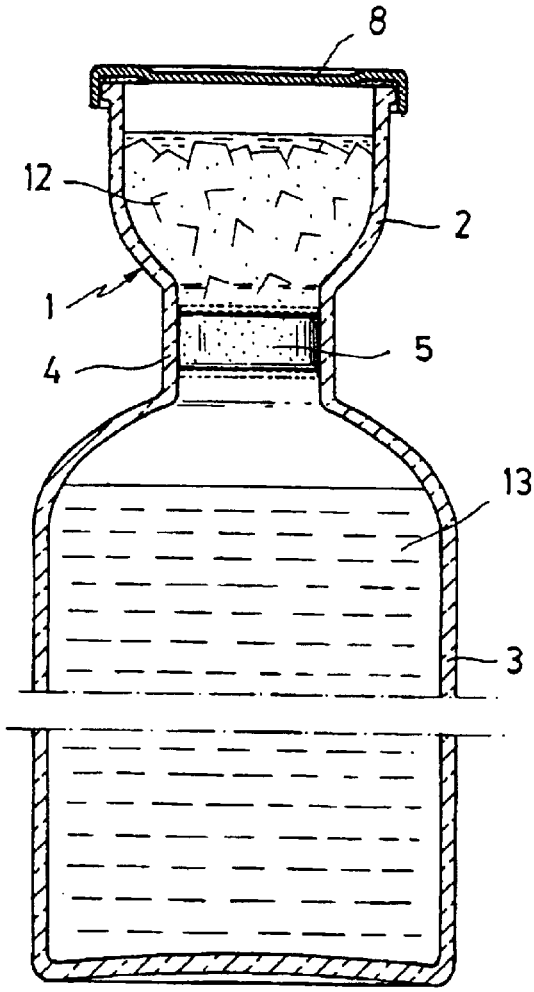
FIG. 1 is a diametrical section of a package to develop the complex packaging device of the invention in its application to contain the components of a sangria.

As shown in FIG. 1, the complex packaging device of the invention is embodied by means of a package or container 1, preferably of glass, that is differentiated in a upper enclosure 2, provided with openable stoppering means, a lower enclosure 3, usually of greater capacity than the upper enclosure 2, and an intermediate tubular portion that, as a cylindrical, or other polygonally-shaped neck 4, connects both said enclosures together.

The said intermediate cylindrical neck 4 will usually be in the vertical position coinciding with that of sustentation of the container 1, nevertheless it could be in a horizontal or inclined position depending on the organization of the package.

The interior spaces of both the upper 2 and the lower 3 enclosures are separated from one another by means of a stoppering partition that can consist of a thick solid one-piece disk 5, of a disk divided into two or more parts 6 that, held in juxtaposition by their flat surfaces 6A, are equivalent to a solid one-piece disk 5 or of a one-piece lipped disk 7. In all cases, the stoppering partition has its main plane perpendicular to the interior walls of the intermediate cylindrical neck 4 and it is of sufficient thickness so that it can slide inside the said cylindrical neck without being warped or overturned.

Figure 3:
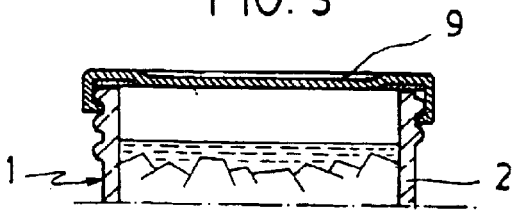
FIG. 3 is a view of a mouth of one embodiment of the complex package in which the cap is of the threaded type, instead of being a vacuum closure, as in the case of FIG. 1.

The openable stoppering means of the upper enclosure 2 can be formed by a vacuum cap 8, as may be seen in FIG. 1, or a threaded or "twist-off" cap 9, as shown in FIG. 3.

Figure 4:
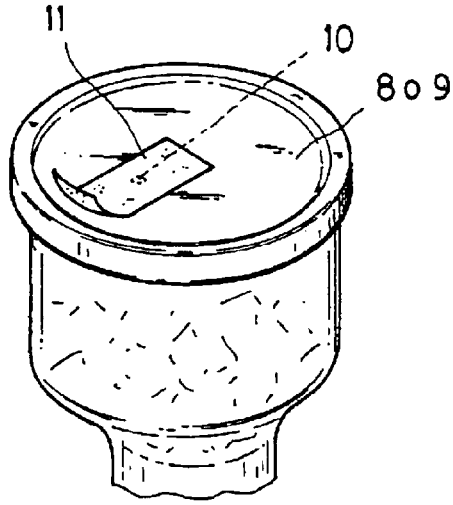
FIG. 4 is a top perspective view of a mouth of a complex package having a threaded or "twist-off" cap or a vacuum cap provided with an opening operculum sealed by a manually removable sheet adhered thereto.
Figure 5:
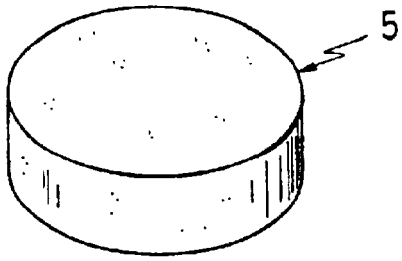
FIG. 5 is a perspective view of a one-piece natural or synthetic stoppering partition.

Said vacuum cap 8 will be used when there is a reduced pressure inside the upper 2 and lower 3 enclosures, it being possible to use, to facilitate opening thereof, the arrangement contemplated in FIG. 4 that consists of forming in the vacuum cap 8 an openable operculum formed by a hole 10 and a stoppering sheet 11 that adheres to said cap and may be pulled off by hand.

It will be obligatory to use the threaded caps 9 when there is a high pressure in the upper 2 and lower 3 enclosures, that is to say, a pressure higher than atmospheric pressure. Nevertheless, they may also be used where there is a reduced pressure or vacuum in such enclosures, it even being possible to provide them with the operculum arrangement described for the vacuum caps.

In the case of the complex packaging device shown in FIG. 1, it has been assumed that in the upper enclosure 2, stoppered by the vacuum cap 8, there is a mixture of natural fruits 12 in an appropriate liquid (liquor, juice, etc.), or candied, dehydrated or sterilized fruits, which are appropriate for their condition to be mixed with a red wine 13 contained in the lower enclosure 3, both enclosures being separated by the stoppering partition 5, applied in the cylindrical neck 4, and subject to an equal level of vacuum, whereby the stoppering partition 5 will be held motionless in said intermediate cylindrical neck 4, it being able to undergo slight displacements toward one or the other of the upper 2 or lower 3 enclosures depending on small variations of pressure that may occur, without these in any case being able to cause displacement of said stoppering partition 5 in the sense of putting both said enclosures in communication. Nevertheless, the arrangement has been contemplated of one or more smaller annular shoulders to hinder the displacement of the stoppering partition 5 in the face of slight variations of pressure, as is shown in phantom lines in FIGS. 1 and 2, but which do not prevent unstoppering at the time of use of the content of the container 1.

Figure 2:
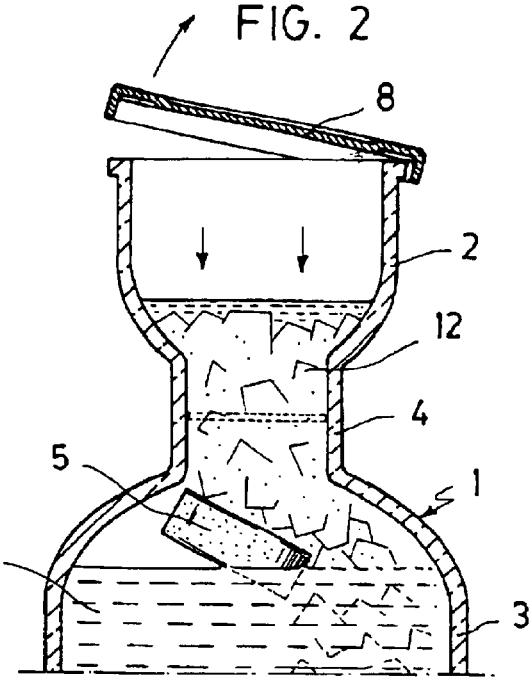
FIG. 2 is a view of an upper portion of the package of the previous figure, at the time of opening.
Figure 6:
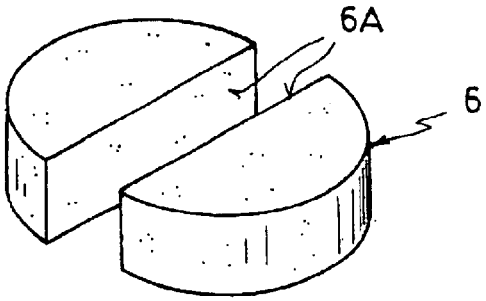
FIG. 6 is a perspective view of a stoppering partition divided into two juxtaposable parts.
Figure 7:
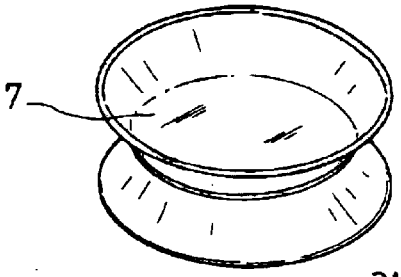
FIG. 7 is a perspective view of a synthetic plastics molded stoppering partition.

When it is wanted to consume the content of said package of FIG. 1, it will be sufficient to remove the vacuum cap 8, as shown in FIG. 2, to break the vacuum in the upper enclosure 2 and the atmospheric pressure acting thereon will press on the natural fruits 12, contained therein, and will also press on the stoppering partition 5, displacing it along the cylindrical neck 4 and pushing it to the interior of the lower enclosure 3, into which the fruits 12 will also fall, mixing with the wine 13, after which it will be possible to pour the content into the appropriate tasting glasses. This content will be a "sangria", when red wine is used, or a "tisana" or "cup", when a sparkling wine (cava, champagne, etc.) is used, without excluding other combinations.

Where the stoppering partition 5 is edible, if it is solid, it will remain inside the lower enclosure 3 and it will not be possible to eat it, the same as when it is a lipped disk 7, but if it is edible and has the portioned arrangement contemplated in FIG. 6, the parts 6 of the stoppering partition will come out together with the fruits 12 and it will be possible to consume them.

The same will happen if in the upper enclosure 2, instead of the natural fruits 12, there is a cooked soup pasta, cereals or others and in the lower enclosure 3 there is, respectively, broth, milk, etc.

Figure 8:
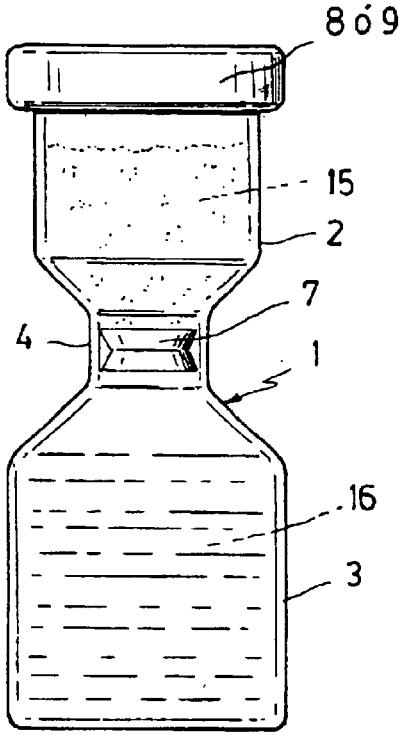
FIG. 8 is a side elevation view of the complex packaging device used as a package for pharmaceutical use.

The same will happen where the complex packaging device is dedicated to pharmaceutical uses, as the package represented in FIG. 8, in which in the upper enclosure 2 there is a pharmaceutical active principle 15 and in the lower enclosure 3 a solvent 16 therefor, with the device being stoppered by a vacuum cap 8 or threaded or twist-off cap 9 and the enclosures separated by a lipped disk 7, both enclosures being under high vacuum and in a sterile atmosphere.

Figure 9:
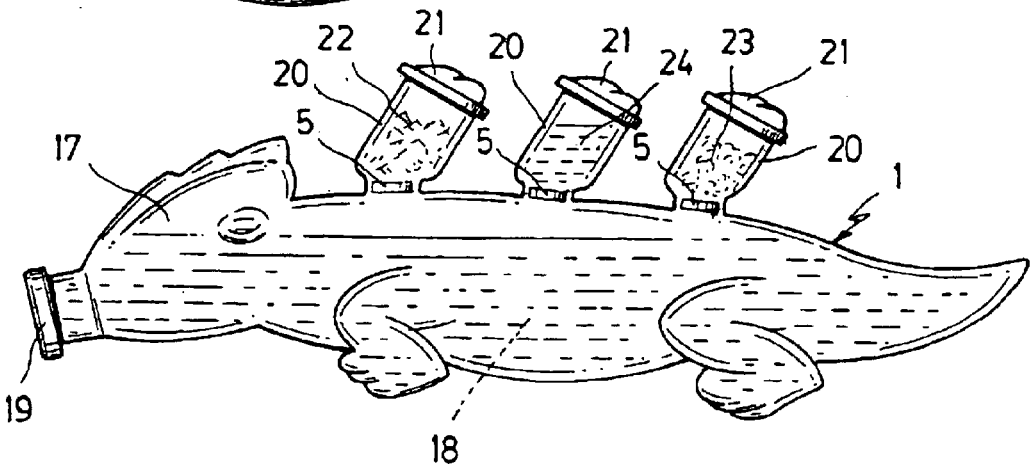
FIG. 9 is a side elevation view of a multiple complex package according to the invention having the zoomorphical shape of an iguana.

Further, using the complex packaging device, a zoomorphically shaped package can be designed, such as the one shown in FIG. 9 that consists of the grotesque representation of an iguana which is formed by a main enclosure 17, containing a beverage 18, having a stopper or plug 19 in its mouth and a plurality of secondary enclosures 20 provided with stoppers or plugs 21, in which solid substances 22 and 23 and liquid 24 are contained and which are introduced in the main enclosure 17 when the plug 19 is opened, by displacement of the stoppers 5.

What is claimed is:

1. A complex packaging device for separately containing two or more products to be mixed at the time of use, comprising:

two or more enclosures communicating with each other by an intermediate tubular portion of the same or smaller diameter, one of the enclosures being provided with an openable stopper, separated by a stoppering partition and each of said enclosures is filled with one of the products and with a gaseous fluid compatible with each of said products, said gaseous fluid being substantially subject to pressures different from the atmospheric pressure, wherein the pressures of both enclosures separated by the stoppering partition are either above or below the limits of the normal oscillations of the atmospheric pressure, said pressures exerting an equal force on both sides of the stoppering partition, maintaining a functional balance between both enclosures, and wherein said stoppering partition is formed by an edible natural material located in the intermediate tubular portion along which it may move slightly, without losing its stoppering capacity, because of the forces formed in both enclosures by small pressure differences in the gaseous fluids contained therein.

2. The complex packaging device according to claim 1, wherein the stoppering partition is diametrically divided into two or more parts that also act as a stopper by their juxtaposed flat surfaces.

3. The complex packaging device according to claim 1, wherein the stoppering partition is held in place lightly by at least one small shoulder provided in the intermediate tubular portion of the package that does not prevent unstoppering or the contents being mixed at the time of opening the package.

4. The complex packaging device according to claim 2, wherein the stoppering partition is held in place lightly by at least one small shoulder provided in the intermediate tubular portion of the package that does not prevent unstoppering or the contents being mixed at the time of opening the package.

5. The complex packaging device according to claim 1, wherein one of the enclosures of the package contains a mixture of fruits in an aromatic liquid, while the other enclosure contains wine.

6. The complex packaging device according to claim 5, wherein, when the wine is still wine, a reduced pressure is formed in the enclosures.

7. The complex packaging device according to claim 5, wherein, when the wine is a sparkling wine, a high pressure is formed in the enclosures.

8. The complex packaging device according to claim 1, wherein in one of the enclosures there is contained a cooked edible pasta, while the other contains a broth for a soup, with one same level of reduced pressure being maintained in both enclosures.

9. The complex packaging device according to claim 1, wherein one of the enclosures contains a cereal product, while the other contains a dairy product, with one same level of reduced pressure being maintained in both enclosures.

10. The complex packaging device according to claim 1, wherein several secondary enclosures are arranged in a package connected, through short tubular portions provided with a stoppering partition, with a main enclosure, all of them having of a stopper, with only that of the main enclosure being openable, each secondary enclosure containing under reduced pressure a liquor, syrup, fruits or other items that are mixed with the contents of the main enclosure at the time of the opening thereof.

* * * * *